US008791820B2

(12) United States Patent
Morrow et al.

(10) Patent No.: US 8,791,820 B2
(45) Date of Patent: Jul. 29, 2014

(54) DEVICE LOCKING SYSTEMS, LOCK TREES, AND LOCKOUT METHODS

(75) Inventors: Carl R. Morrow, Longview, WA (US); G. Jeff Maestretti, Walla Walla, WA (US)

(73) Assignee: Lok-Alert, LLC, Walla Walla, WA (US)

( * ) Notice: Subject to any disclaimer, the term of this patent is extended or adjusted under 35 U.S.C. 154(b) by 0 days.

(21) Appl. No.: 13/480,892

(22) Filed: May 25, 2012

(65) Prior Publication Data

US 2013/0135102 A1 May 30, 2013

Related U.S. Application Data

(63) Continuation of application No. 11/489,657, filed on Jul. 18, 2006, now abandoned.

(51) Int. Cl.

| | |
|---|---|
| ***E05B 45/06*** | (2006.01) |
| ***G08B 1/08*** | (2006.01) |
| ***G08B 13/08*** | (2006.01) |
| ***G08B 13/14*** | (2006.01) |
| ***E05B 73/00*** | (2006.01) |
| ***G05G 5/00*** | (2006.01) |
| ***H01H 27/06*** | (2006.01) |

(52) U.S. Cl.
USPC ..... 340/542; 340/539.1; 340/546; 340/545.4; 340/571; 70/14; 70/19; 70/203; 200/61.64

(58) Field of Classification Search
USPC ..... 340/542
See application file for complete search history.

(56) References Cited

U.S. PATENT DOCUMENTS

| | | | | |
|---|---|---|---|---|
| 3,667,259 | A * | 6/1972 | Reque et al. | 70/14 |
| 3,889,497 | A * | 6/1975 | Tuttle | 70/14 |
| 3,993,987 | A * | 11/1976 | Stevens | 340/542 |
| 4,085,599 | A * | 4/1978 | Fischer et al. | 70/14 |
| 4,811,578 | A * | 3/1989 | Masoncup et al. | 70/38 B |
| 4,864,834 | A * | 9/1989 | Waite | 70/14 |
| 4,997,219 | A * | 3/1991 | Carter | 292/153 |
| 5,743,116 | A * | 4/1998 | Suster | 70/14 |
| 5,868,015 | A * | 2/1999 | Eaker | 70/129 |
| 6,002,343 | A | 12/1999 | Auerbach et al. | |
| 6,215,396 | B1 * | 4/2001 | Script | 340/545.1 |
| 6,255,958 | B1 * | 7/2001 | Haimovich et al. | 340/686.6 |
| 6,281,793 | B1 | 8/2001 | Haimovich et al. | |
| 6,324,877 | B2 | 12/2001 | Neeley | |
| 6,366,301 | B1 | 4/2002 | Thomas et al. | |

(Continued)

OTHER PUBLICATIONS

U.S. Appl. No. 11/401,545, Apr. 11, 2006, Loudon.
"Chapter 11—Miscellaneous Safety Policies, H. Lockout/Tagout Policy"; www.niehs.nih.gov/odhsb/manual/man11h.htm; 2001; 11pps.

(Continued)

*Primary Examiner* — Jennifer Mehmood
*Assistant Examiner* — John Mortell
(74) *Attorney, Agent, or Firm* — Wells St. John P.S.

(57) ABSTRACT

Device locking systems, lock trees, and lockout methods are described according to some aspects. In one aspect, a device locking system includes a lock system configurable into a first configuration to lock a device to be secured and a second configuration wherein the lock system is configured to be attached to or removed from the device, wherein the lock system is configured to be locked into the first configuration at a desired moment in time by at least one lock, and circuitry configured to generate an alarm responsive to a change of the configuration of the lock system from the first configuration to the second configuration.

21 Claims, 3 Drawing Sheets

(56) References Cited

U.S. PATENT DOCUMENTS

| | | | |
|---|---|---|---|
| 6,420,971 | B1 | 7/2002 | Leck et al. |
| 6,844,512 | B2 | 1/2005 | Benda |
| 6,994,258 | B2 | 2/2006 | Lewis |
| 7,026,932 | B2 | 4/2006 | Loudon |
| 7,242,297 | B2 | 7/2007 | Vogt |
| 2003/0038720 | A1 | 2/2003 | Shugrue |
| 2003/0052780 | A1 | 3/2003 | Buckley |
| 2004/0245077 | A1 | 12/2004 | Benda |
| 2005/0024207 | A1 | 2/2005 | Schnebel et al. |
| 2005/0231365 | A1 | 10/2005 | Tester |
| 2006/0027642 | A1 | 2/2006 | Lewis |

OTHER PUBLICATIONS

"Circuit Breaker Lockout Kit"; www.reecesafety.co.uk/Lockout%20kits.htm; Jul. 13, 2006; 4 pps.

"Front Line Sales, Lockout/Tagout Equipment"; www.frontlinesales.com.signs.htm; Jul. 13, 2006; 2 pps.

"Lock-out/tag-out"; www.netherlocks.com/lt-mpl.php?PHPSESSID=7e1b5aa12ec546aa952212bca8cd03bc; Jul. 13, 2006; 1 pp.

"Lockout & Tagout"; www.southernsafetysupply.net/742388.htm; Jul. 13, 2006; 5 pp.

* cited by examiner

DEVICE LOCKING SYSTEMS, LOCK TREES, AND LOCKOUT METHODS

CROSS REFERENCE TO RELATED APPLICATION

This application is a continuation of U.S. patent application Ser. No. 11/489,657, which was filed on Jul. 18, 2006 now abandoned and which is incorporated herein by reference.

TECHNICAL FIELD

This invention relates to device locking systems, lock trees, and lockout methods.

BACKGROUND

Many laws and regulations mandate rigid employee safety guidelines throughout construction, chemical production, manufacturing and general industrial work environments in illustrative examples. Some guidelines specify locking out or tagging out ("lock out-tag out") equipment and/or hazardous machinery or areas during service, maintenance, assembly and set-up, or other situations where worker peril, danger or hazards exist. Lockout devices have been used to increase safety in many applications, including with respect to large or potentially dangerous equipment and high voltage electrical circuits.

BRIEF DESCRIPTION OF THE DRAWINGS

Preferred embodiments of the invention are described below with reference to the following accompanying drawings.

DETAILED DESCRIPTION

According to one aspect of the disclosure, a device locking system comprises a lock system configurable into a first configuration to lock a device to be secured and a second configuration wherein the lock system is configured to be attached to or removed from the device, wherein the lock system is configured to be locked into the first configuration at a desired moment in time by at least one lock, and circuitry configured to generate an alarm responsive to a change of the configuration of the lock system from the first configuration to the second configuration.

According to another aspect of the disclosure, a lock tree comprises a lock system configurable into a first configuration to lock a device to be secured, wherein the lock system is further configurable into a second configuration to be removable from the device, wherein the lock system is configured to receive at least one lock to restrict an individual from changing the lock system from the first configuration to the second configuration, and circuitry configured to generate an alarm responsive to a change of the configuration of the lock system from the first configuration to the second configuration.

According to yet another aspect of the disclosure, a lockout method comprises providing a lock system in an open configuration, attaching the lock system in the open configuration to a device to be secured, providing the lock system in a closed configuration while the lock system is attached to the device, locking the device and the lock system provided in the closed configuration using a lock, first removing the lock from the lock system after the locking, providing the lock system in the open configuration after the first removing, second removing the lock system in the open configuration from the device after the first removing, and generating an alarm signal responsive to the second removing.

Figure 1:
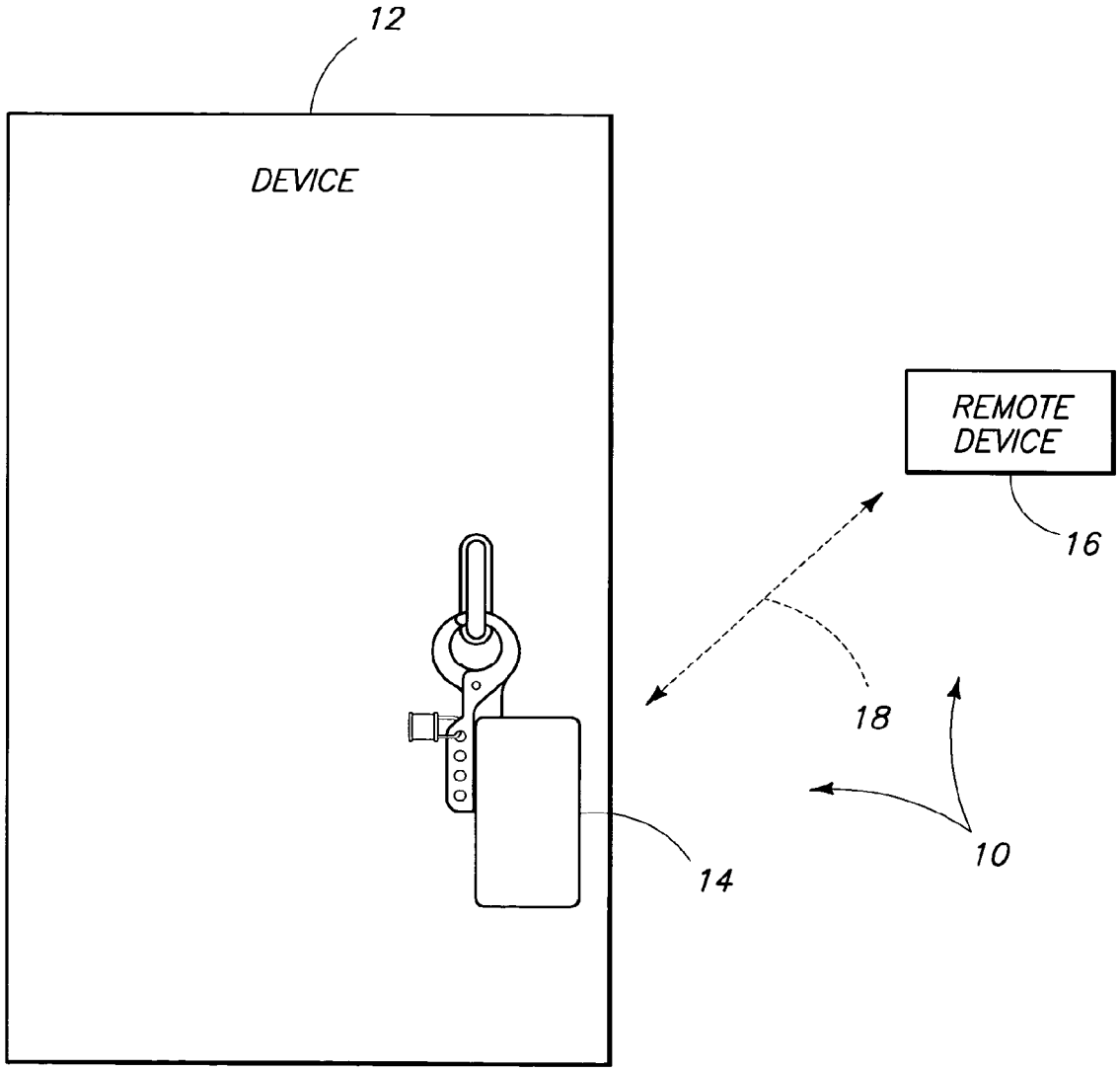
FIG. 1 is an illustrative representation of a device locking system attached to a device according to one embodiment.

FIG. 1 illustrates an exemplary configuration of a device locking system 10 according to one embodiment. The device locking system 10 is attached to a device 12 which is secured or locked. For example, device locking system 10 may be used to lock a device 12 (which is to be secured) to permit individuals to access device 12 for service, maintenance, assembly and set-up or other reasons. Device 12 may operate in a plurality of operational modes. For example, device 12 may be a powered device capable of operating in modes including a powered state and a non-powered state. Device 12 may have a control panel which may be locked into a non-powered or operational state using system 10 according to one illustrative aspect. Illustrative configurations of device 12 include heavy machinery (such as cranes), high voltage electrical equipment, various industrial or manufacturing equipment, access doors to a work area or room to be secured, or other equipment or devices which may be locked out. In another example, device 12 may be a door for access to a potentially dangerous area and device locking system 10 may lock the door closed to restrict access to the area.

Device locking system 10 is arranged to lock device 12 which may include restricting access of individuals to device 12 once locked. For example, device locking system 10 may restrict individuals from changing the operational mode of a device 12 which is locked by system 10. As mentioned above, system 10 may lock a door in another example. As described in further detail in an example below, device locking system 10 may include a lock tree and be used to lock out/tag out device 12 in one implementation.

In a more specific passive lockout example, a worker may use a lock system of device locking system 10 (i.e., an exemplary lock system is referred to as reference 14 below) to lock device 12 prior to working on the device 12. The initial worker may install lock system 14 to lock device 12 and may have his own respective lock which is used to lock both the lock system 14 and device 12. Thereafter, other workers may also work with the initial worker and also lock the system 14 and device 12 using their respective individual locks. Subsequently, the respective individuals may remove their respective locks when they are finished working and the final individual to remove his lock may also remove the lock system 14 to unlock device 12 allowing normal operation to resume. A supervisor may install and remove lock system 14 in some arrangements. As discussed below, alarm signals are generated to indicate removal of lock system 14 from device 12 which may indicate removal by unauthorized personnel or that a potentially dangerous situation exists.

Still referring to FIG. 1, the depicted device locking system 10 includes a lock system 14 and a remote device 16 according to one embodiment. In the illustrated exemplary embodiment, the lock system 14 may be physically attached to a portion of device 12 to lock the device 12. Lock system 14 may be referred to as an attachment device in arrangements wherein lock system 14 is attached to device 12. Lock system 14 may also be referred to as a local device in some arrangements.

Lock system 14 may communicate with remote device 16, for example, using communication signals 18 (e.g., wired signals or electromagnetic wireless signals) in one implementation. One or both of lock system 14 and remote device 16 may include respective circuitry individually configured to generate a human perceptible alarm signal to alert individual(s), such as workers, to operations of device locking system 10. For example, the alarm signals may indicate unlocking of lock system 14 and the locking provided thereby of device 12. In one more specific example, the alarm signals may indicate the removal of the restriction provided by system 10 upon the ability to change the mode of operation of device 12. In one embodiment, lock system 14 may generate local alarm signals at the location of device 12 and remote device 16 may be worn on the person of an appropriate individual (e.g., supervisor, worker, etc.) and generate remote alarm signals away from device 12. Remote device 16 may be configured as a personal pager in one implementation.

Figure 2:
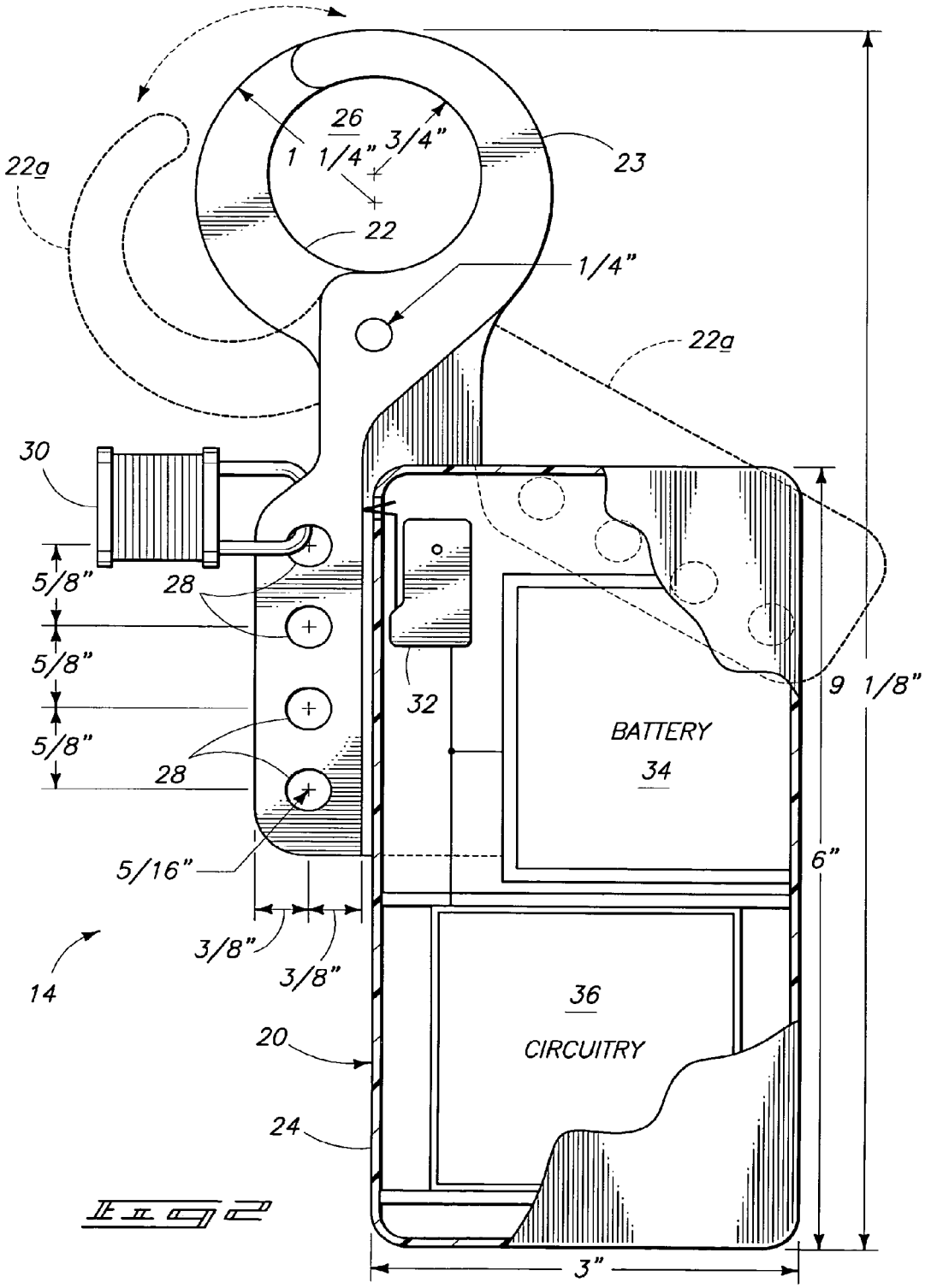
FIG. 2 is an illustrative representation of a lock system according to one embodiment.

Referring to FIG. 2, additional details of a configuration of lock system 14 configured as a lock tree in one embodiment are shown. Lock system 14 includes a body 20 and a plurality of attachment members 22, 23 in the illustrated exemplary embodiment. Body 20 includes a housing 24 which houses a switch 32, a battery 34 and electrical circuitry 36 in the depicted arrangement. Other embodiments of device 14 are possible including more, less and/or alternative components.

Attachment members 22, 23 may comprise opposing jaws or tangs of a tang closure jaw in one embodiment. Attachment member 22 is movable between the illustrated position and the position 22*a* while attachment member 23 is fixed with respect to housing 24 in one embodiment. The illustrated location of attachment members 22, 23 may be referred to as one configuration of lock system 14 while positioning of attachment member 22 in position 22*a* may be referred to as another different configuration of lock system 14. In the illustrated configuration (which may be referred to as a closed configuration) of lock system 14, attachment members 22, 23 define an aperture 26 which may be used to lock device 12 (device 12 is not shown in FIG. 2) for example by passing a portion of device 12, such as a latch, hasp, or control arm, through aperture 26.

As mentioned above, device 12 may include other configurations apart from machinery or electrical equipment. In other additional illustrative examples, lock system 14 may be attached to device 12 such as a door to an entrance of an area or a room, a primary control of device 12 or a switch-arm of an electrical control box of device 12. Locking of device 12 using lock system 14 restricts access to the area or room, locks machinery in an "off" mode of operation, or locks an electrical control box in an "off" state in illustrative examples. In the configuration shown by providing attachment member 22 in position 22*a*, lock system 14 may be referred to as being in an open configuration and lock system 14 may be removed from or attached to device 12.

In one example of device 12 being locked or provided in a locked configuration, lock system 14 may lock device 12 into a mode of operation. For example, lock system 14 may restrict an operation of device 12 or restrict changing of a mode of operation of device 12 from one mode of operation to another mode of operation. For example, lock system 14 may restrict unauthorized individuals from changing a mode of operation of device 12 (e.g., applying or removing power, starting or halting operation in illustrative examples), accessing or changing a control of device 12, or opening or closing a door locked by lock system 14. Device 12 may be referred to as being unlocked when lock system 14 is not configured to impede an operation of device 12 in one example.

Lock system 14 (and device 12 if lock system 14 is associated in a locking arrangement with respect to device 12) may be locked by one or more lock 30 as described below. Changing a configuration of lock system 14 between configurations (e.g., from a closed to open configuration) is restricted when lock system 14 is locked in one embodiment. In one embodiment, lock system 14 may be considered to be locked to device 12 when lock system 14 is attached is an arrangement to lock device 12 and removal of lock system 14 from device 12 is restricted.

Individual ones of the attachment members 22, 23 include a plurality of apertures 28 which are aligned with one another when lock system 14 is provided in a closed configuration. When lock system 14 is in a closed configuration, a user may provide the lock system 14 in a locked configuration by attaching one or more lock 30 to the aligned apertures 28 of both members 22, 23 in one example. Locks 30 may correspond to respective individuals desirous of locking device 12 (e.g., service personnel, supervisors, etc.). Accordingly, once locked by plural individuals, lock system 14 and/or device 12 may be unlocked by removal of the respective locks 30 of the respective individuals and removal of lock system 14 in one exemplary lockout embodiment. Individuals may have respective different keys which permit them to remove their respective locks 30. Other embodiments are possible. For example, a supervisor may have a master key to open all locks 30 if desired. Attachment of a plurality of locks 30 offers redundancy inasmuch as device 12 and/or lock system 14 remain locked until all locks 30 are removed from lock system 14 in one embodiment.

As mentioned above and discussed in detail below, device locking system 10 is configured to generate alarm signals. Alarm signals may be generated by lock system 14 and/or remote device 16. In one embodiment, the alarm signals may be perceptible to humans (e.g., visible, audible, vibratory, etc.).

Still referring to FIG. 2 and to generation of alarm signals, circuitry 36 is configured to monitor the configuration of lock system 14 including whether the system 14 is in an open or closed configuration. In one example, circuitry 36 is configured to generate the alarm signals responsive to the monitoring of the configuration of the lock system 14. In a more specific example, circuitry 36 is configured to generate the alarm signals responsive to a change of the configuration of the lock system 14 from a closed (and perhaps locked) configuration to an open configuration.

In addition, circuitry 36 may comprise communications circuitry for communicating with remote device 16. In one embodiment, the communications circuitry communicates signals 18 (e.g., transmits wireless RF signals) to remote device 16 to trigger remote device 16 to generate alarm signals. Additional details are discussed below according to illustrative embodiments.

In one exemplary method of locking a device 12, a user may configure lock system 14 in an open configuration. The opened lock system 14 may be attached to a device 12 to be locked and thereafter provided in the closed configuration to lock device 12. After attachment in a way wherein device 12 is locked, a user may attach a lock 30 through aligned apertures 28 to lock the system 14. A plurality of locks 30 may be used to lock lock system 14, for example, by a plurality of workers in an exemplary lockout implementation. Thereafter, the locks 30 may be removed, for example, after work has been completed or perhaps inappropriately. After removal of all locks 30, lock system 14 may be unlocked and may be removed from device 12, operating to unlock device 12. An individual configures lock system 14 in an open configuration to remove the lock system 14. Switch 32 is configured to detect the opening of lock system 14 and changes the state of an outputted signal responsive to the detection. Switch 32 may be implemented in any suitable configuration such as a micro-switch or magnetic switch in illustrative examples. In the described embodiment, switch 32 detects the movement of attachment member 22 between the open and closed configurations of lock system 14.

Circuitry 36 monitors the output of switch 32, detects the change of the state of the outputted signal, and may control the generation of an alarm signal by lock system 14 and/or remote device 16 to signal the unlocking of lock system 14 and device 12 responsive to the detected change of state. In one configuration, a separate lock (not shown) may also be integral with lock system 14 to enable a person with proper authority (e.g., supervisor) to use an appropriate key to defeat the generation of the alarm signal(s) during proper removal of lock system 14.

Figure 3:
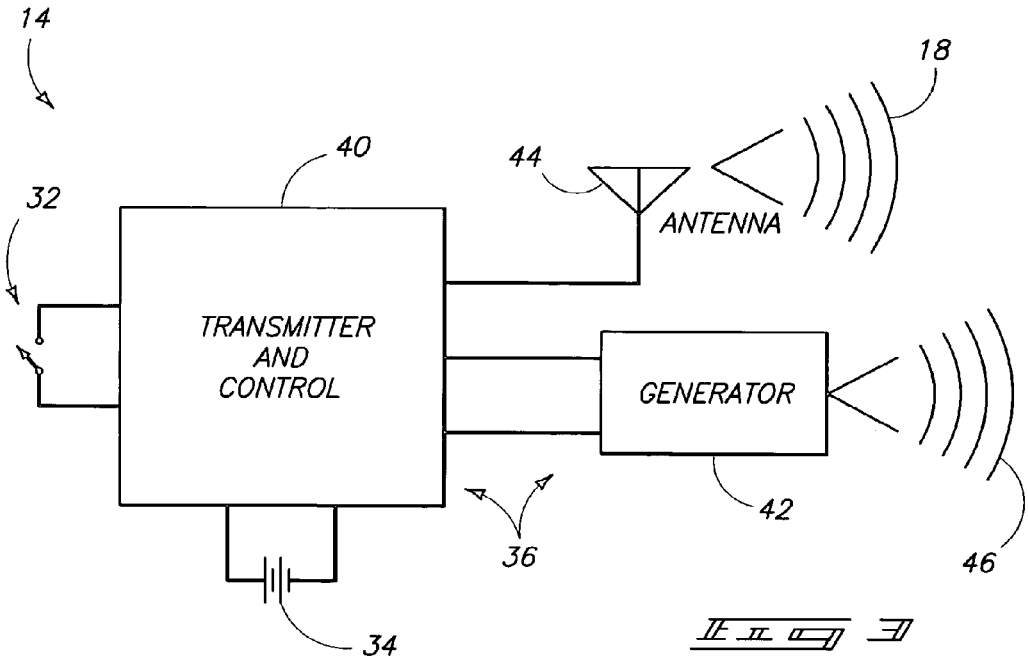
FIG. 3 is a functional block diagram of circuitry of a lock system according to one embodiment.

Referring to FIG. 3, exemplary details of one configuration of circuitry 36 of lock system 14 are shown physically resident at or physically coupled with lock system 14. Circuitry 36 includes transmitter and control circuitry 40, an alarm signal generator 42, and an antenna 44 in the depicted embodiment. Switch 32 may also be considered to be a portion of circuitry 36 in some embodiments. Battery 34 which may comprise two 9 Volt batteries in parallel provides operational electrical energy to components of lock system 14. Other configurations of lock system 14 are possible including more, less and/or alternative components and/or circuits.

Control circuitry of circuitry 40 is configured to detect a signal outputted from switch 32 changing state responsive to the opening of lock system 14. Responsive to the detection of the change of state, the control circuitry is configured to control the emission of communication signals 18 using antenna 44 as well as the generation of an alarm signal 46 by generator 42. Transmitter and control circuitry 40 may comprise a 435 MHz digitally encoded transmitter (e.g., using a 128N protocol in one embodiment) providing a communications range of approximately 1000 feet in one embodiment. Other frequencies may be used, for example 2.4 GHz or 5.8 GHz, in additional arrangements.

Generator 42 may be configured to emit human perceptible signals which may include audible, visible and/or vibratory signals in exemplary embodiments. In one arrangement, generator 42 is in the form of a piezo siren (e.g., 104 dB). Generator 42 may alternatively or also include one or both of a light source (e.g., LED) and/or a mechanical (e.g., vibrasponder) in some embodiments.

Figure 4:
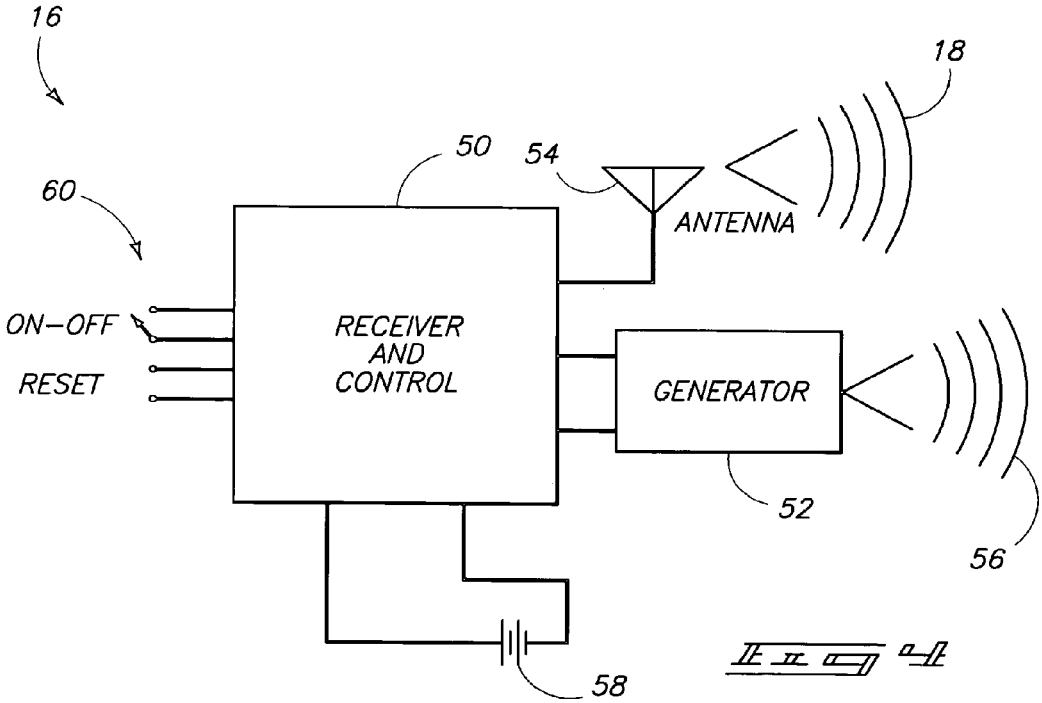
FIG. 4 is functional block diagram of circuitry of a remote device according to one embodiment.

Referring to FIG. 4, exemplary details of one configuration of remote device 16 are shown. Remote device 16 includes receiver and control circuitry 50, an alarm signal generator 52, an antenna 54, and a battery 58 in the depicted embodiment. Remote device 16 may be configured similar to a pager in one embodiment. Battery 58 is configured to provide operational electrical energy for use by remote device 16. Other configurations of remote device 16 are possible including more, less and/or alternative components and/or circuits.

Control circuitry of circuitry 50 is configured to detect reception of communication signals 18 by antenna 54, to identify the communication signals 18 as being generated by an appropriate lock system 14 (e.g., with proper digital coding which may uniquely identify the lock system 14), and to control the generation of an alarm signal 56 by generator 52 responsive to the reception of an appropriate signal 18 from system 14. Receiver and control circuitry 50 may reject signals which do not have proper coding of lock system 14 in some embodiments to reduce false alarms.

Generator 56 may be configured to emit human perceptible signals which may include audible, visible and/or vibratory signals in exemplary embodiments. As mentioned above, remote device 16 may be associated with the person of an individual in one embodiment, and the individual may access switches 60 to implement a reset (defeat the alarm signal at remote device 16) or turn the device 16 off. Thereafter, the individual may investigate the situation at device 12 and take appropriate action if necessary.

In some embodiments, both lock system 14 and remote device 16 generate alarm signals responsive to unlocking and opening of lock system 14. In other examples, only one of the lock system 14 and remote device 16 generate alarm signals. In additional arrangements, other devices, such as a remote monitoring centralized station (not shown) may be in communication with one or more lock systems 14 and may also generate alarm signals. In other embodiments, remote device 16 may be omitted or additional remote devices 16 may be provided and worn by respective workers.

In some embodiments, a single remote device 16 communicates with a plurality of respective lock systems 14 which may be used to simultaneously lock separate respective devices 12 (e.g., which may or may not be proximately located to one another). Communication signals 18 intermediate the lock systems 14 and remote device 16 may also identify a particular communicating lock system 14 for example using a respective code so a user of remote device 16 may identify which specific lock system 14 has been removed and which device 12 is no longer safe.

As described above, at least one embodiment provides a local alarm signal at the location of the device 12 being locked as well as an additional remote alarm signal for example at the location of a supervisor to inform individuals that lock system 14 in the form of a safety device has been removed and there may be impending danger. The above-described lock out embodiment is illustrative and device locking system 10 may be used in other implementations in other embodiments.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure

What is claimed is:

1. A hazard alarm method comprising:

using a control of a hazardous device, providing the hazardous device in a reduced hazard state which presents less risk compared with another state of operation of the hazardous device;

locking the control of the hazardous device to maintain the hazardous device in the reduced hazardous state;

locking alarm circuitry to the hazardous device;

using the alarm circuitry locked to the hazardous device, monitoring a state of the locking of the control of the hazardous device;

during the monitoring, detecting a change in the state of the locking of the control of the hazardous device;

as a result of the detecting, generating an alarm signal to indicate the change in the state of the locking of the control of the hazardous device;

wherein the locking the control of the hazardous device and the locking alarm circuitry individually comprise locking a lock system to the hazardous device using a plurality of locks, and further comprising:

removing all of the locks from the lock system to unlock the lock system; and removing the unlocked lock system from the control of the hazardous device after all the locks have been removed, and wherein the detecting comprises detecting the removal of the unlocked lock system from the control of the hazardous device, and the generating comprises generating the alarm signal only as a result of the removal of the unlocked lock system from the control of the hazardous device after all of the plurality of locks have been removed.

2. The method of claim 1 further comprising, using first circuitry physically coupled with the hazardous device, outputting an electrical signal having a state, and wherein the monitoring comprises monitoring the electrical signal using the first circuitry and the detecting comprises detecting a change of the state of the electrical signal using the first circuitry, and wherein the generating an alarm signal comprises, using the first circuitry, emitting a first human perceptible alarm signal at the physical location of the hazardous device, and further comprising, using the first circuitry, wirelessly transmitting another signal to second circuitry which is remotely located from the first circuitry, and, using the second circuitry, emitting a second human perceptible alarm signal as a result of the second circuitry receiving the another signal.

3. The method of claim 1 wherein the generating comprises generating the alarm signal to indicate that the alarm circuitry is not locked to the hazardous device.

4. The method of claim 1 wherein the generating comprises generating the alarm signal to indicate that the control of the hazardous device is not locked.

5. The method of claim 1 further comprising changing a state of an electrical signal as a result of the change in the state of a switch, and wherein the generating comprises generating as a result of the changing of the state of the electrical signal.

6. The method of claim 1 wherein the generating comprises generating the alarm signal using first circuitry which is physically coupled with the hazardous device, and further comprising:

transmitting another signal from the physical location of the hazardous device to second circuitry which is located remotely from the hazardous device; and emitting another alarm signal using the second circuitry which is located remotely from the hazardous device.

7. A hazard alarm method comprising:

configuring a hazardous device from a first state to a second state, the hazardous device presenting reduced risk of injury to an individual accessing the hazardous device in the second state compared with the first state;

attaching a lock system to the hazardous device in the second state to lock the hazardous device in the second state and to impede changing the hazardous device to the first state while the lock system is attached to the hazardous device;

with the lock system attached to the hazardous device, changing a state of the lock system from an unlocked state to a locked state using a plurality of locks to impede removal of the lock system from the hazardous device and to impede changing the hazardous device from the second state to the first state;

with the lock system attached to the hazardous device, monitoring a state of the lock system;

communicating a signal indicating the state of the lock system;

removing individual ones of the locks at a plurality of different moments in time which provides the lock system in the unlocked state wherein all of the locks have been removed from the lock system;

removing the lock system in the unlocked state from the hazardous device after the attaching; and wherein the communicating comprises communicating an alarm signal only as a result of the removing of the lock system in the unlocked state from the hazardous device.

8. The method of claim 7 wherein the communicating comprises communicating the signal comprising an alarm signal to indicate the state of the lock system in an unlocked state.

9. The method of claim 7 wherein the communicating comprises communicating the signal comprising an alarm signal to indicate a change in the state of the lock system from an initial state to another state where the lock system may be removed from the hazardous device.

10. The method of claim 7 wherein the monitoring and communicating comprise monitoring and communicating using circuitry of the lock system which is physically attached to the hazardous device.

11. The method of claim 7 wherein the signal comprises one signal, and further comprising generating an other signal using circuitry which is physically attached to the hazardous device, and wherein the monitoring comprises monitoring for a change of state of the other signal, and the communicating comprises communicating the one signal as a result of the monitoring detecting the change of state of the other signal.

12. The method of claim 11 further comprising changing a state of a switch as a result of a change of the state of the lock system, and wherein the other signal changes state as a result of the change of the state of the switch.

13. The method of claim 7 wherein the signal comprises one signal, and the communicating comprises communicating the one signal using circuitry physically coupled with the hazardous device, and further comprising:

receiving the one signal using circuitry physically remote from the hazardous device; and generating a human perceptible alarm using the circuitry which is physically remote from the hazardous device.

14. The method of claim 7 wherein the communicating comprises communicating the signal to indicate a potential change in the state of the hazardous device from the second state to the first state.

15. A hazardous device lock system comprising:

a lock system configured to be attached and locked to a hazardous device which has different operational states, and wherein the hazardous device presents different risks of injury to an individual accessing the hazardous device while the hazardous device is in the different operational states;

wherein the lock system is further configured to lock the hazardous device in one of the different operational states which presents reduced risk of injury to the individual and to impede changing of the hazardous device to an other of the different operational states when the lock system is attached and locked to the hazardous device, the other of the different operational states having increased risk of injury to the individual compared with the one of the different operational states;

monitoring circuitry physically coupled with the lock system and locked to the hazardous device when the lock system is attached and locked to the hazardous device;

wherein the monitoring circuitry is configured to monitor a state of the lock system and to generate an alarm to indicate that the lock system is not locked to the hazardous device;

a plurality of individual locks which lock the lock system to the hazardous device; and wherein the locks are removed from the lock system to unlock the hazardous device from the one operational state, and the monitoring circuitry is configured to only generate the alarm after removal of all of the locks from the lock system at different moments in time and removal of the lock system from the hazardous device.

16. The system of claim 15 wherein the monitoring circuitry generates the alarm at the physical location of the hazardous device.

17. The system of claim 16 wherein the monitoring circuitry is configured to transmit a signal to remote circuitry at a location which is remote from the hazardous device and not physically coupled with the lock system, and wherein the remote circuitry is configured to generate another alarm at the location which is remote from the hazardous device.

18. The system of claim 15 wherein the monitoring circuitry is configured to generate the alarm to indicate that the hazardous device is not locked in the one of the different operational states.

19. The system of claim 15 wherein the monitoring circuitry is configured to generate the alarm as a result of a change in the state of the lock system from an initial state to another state where the lock system may be removed from the hazardous device.

20. The system of claim 15 wherein the monitoring circuitry comprises:

a switch configured to change state of an electrical signal corresponding to a change in the state of the lock system; and electrical circuitry configured to monitor the state of the electrical signal and to generate the alarm as a result of the change in the state of the electrical signal.

21. The system of claim 15 wherein the lock system comprises a plurality of attachment members and the individual locks are configured to lock the attachment members in a first position to lock the lock system to the hazardous device, and wherein the monitoring circuitry is configured to only generate the alarm as a result of movement of one of the attachment members from the first position to a second position where the lock system is not locked to the hazardous device.

* * * * *